US006368202B1

(12) United States Patent
Kaiser

(10) Patent No.: US 6,368,202 B1
(45) Date of Patent: Apr. 9, 2002

(54) ROTARY FINISHING TOOL AND METHOD OF MAKING THE SAME

(76) Inventor: Richard A. Kaiser, N84 W28518 Center Oak Rd., Hartland, WI (US) 53029

( * ) Notice: Subject to any disclaimer, the term of this patent is extended or adjusted under 35 U.S.C. 154(b) by 0 days.

(21) Appl. No.: 09/691,715

(22) Filed: Oct. 18, 2000

(51) Int. Cl.[7] ..... B23F 21/03

(52) U.S. Cl. ..... 451/548; 451/344; 451/357; 451/526; 451/528; 451/532

(58) Field of Search ..... 451/344, 357, 451/526, 528, 532, 548

(56) References Cited

U.S. PATENT DOCUMENTS 4,504,283 A * 3/1985 Charvat ..... 51/298

6,001,009 A * 12/1999 Kaiser et al. ..... 451/527

* cited by examiner

*Primary Examiner*—Joseph J. Hail, III

(74) *Attorney, Agent, or Firm*—Andrus, Sceales, Starke & Sawall

(57) ABSTRACT

A rotary surface finishing tool includes a generally circular body of a finishing material, such as polymeric foam, the peripheral edge of which is wrapped around the outer edge of a circular cup-shaped backing plate. The plate is subsequently crimped over the edge of a locking ring to capture the edge of the foam material therebetween. Other types of finishing material, such as tufted wool, including a backing with a flexible peripheral edge can also be mounted to a backing plate using the crimping techniques described herein.

12 Claims, 6 Drawing Sheets

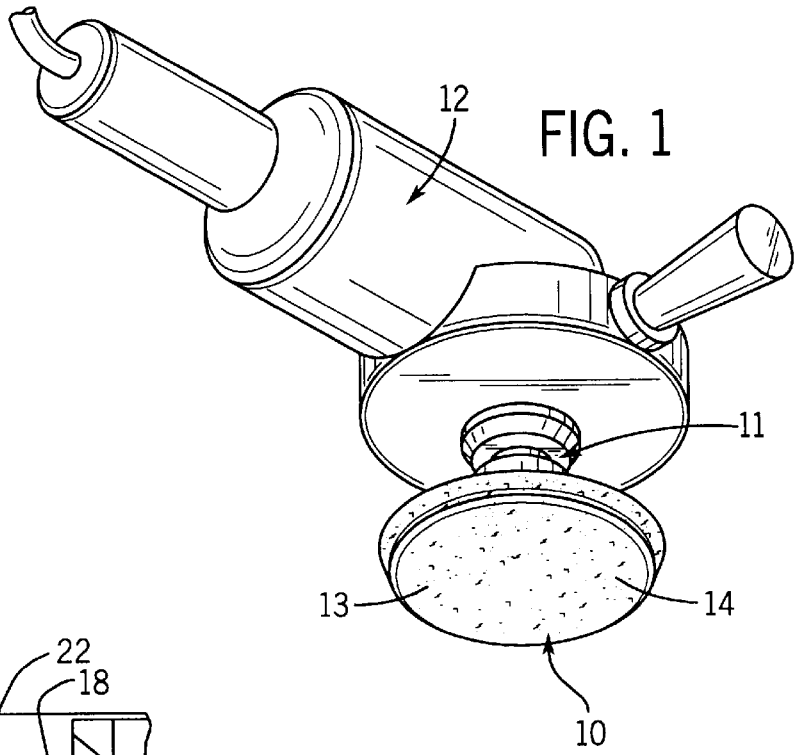
FIG. 1
FIG. 8
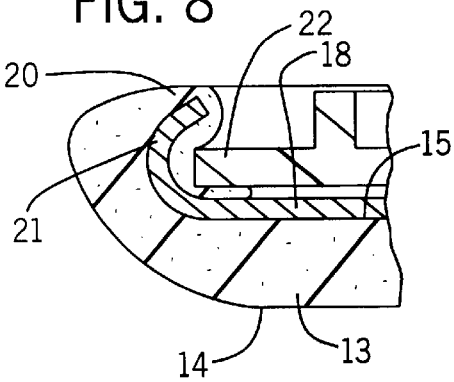
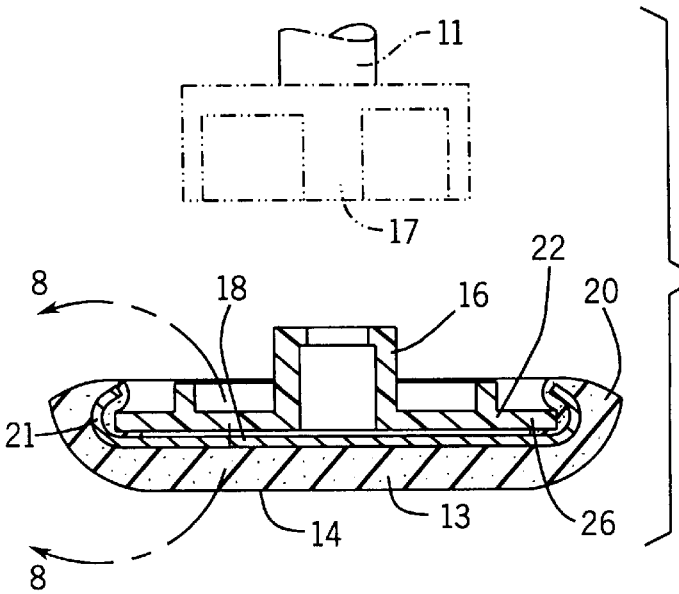
FIG. 2

FIG. 10
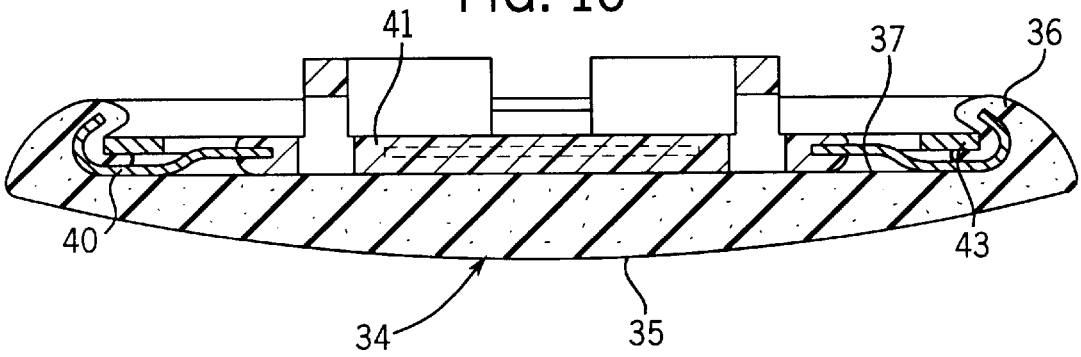
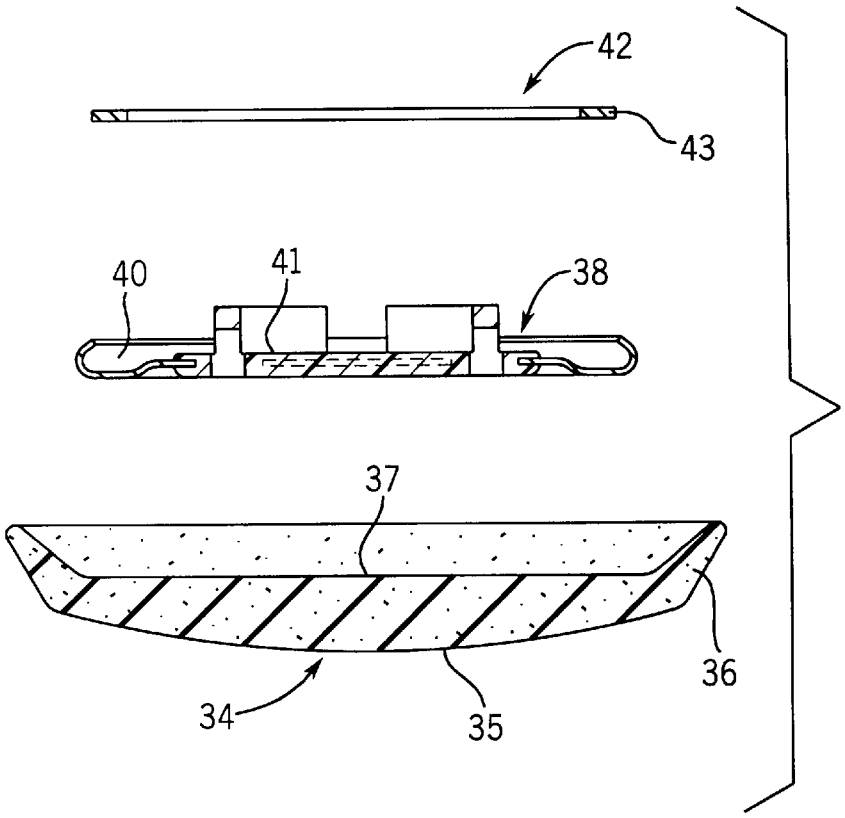
FIG. 11

ROTARY FINISHING TOOL AND METHOD OF MAKING THE SAME

BACKGROUND OF THE INVENTION

The present invention relates to surface finishing tools, such as are used for sanding, buffing, and polishing, and more particularly, a rotary surface finishing tool of a relatively simple construction and a method of making such a tool.

Rotary surface finishing tools, used to provide a wide variety of surface finishing functions including sanding, buffing and polishing, are well known in the art. As used herein, the term "rotary" is meant to include orbitally driven finishing tools which, in most delicate finishing operations, are preferred because of the reduction in swirl marks in the finish of the workpiece. Rotary finishing tools are typically circular in shape and are mounted on the drive spindle or arbor of a powered rotary or orbital driver which is held and manipulated by an operator.

The finishing medium used on rotary finishing tools includes wool and/or other synthetic fiber yarns that are tufted to a fabric backing layer, such as jute, and which are permanently or demountably attached to some sort of backing plate device, the backing plate being attached to the drive spindle of the powered rotary driver. Polymeric foam material is also used as a finishing medium. Such foam materials may be in the form of a solid circular block adhesively attached to a backing layer or an array of polymer foam fingers individually attached to a backing layer in a modified tufting or stuffing operation. The backing layers of either of these types of pads may also be further modified to provide permanent or demountable connection to a rotary backing plate. Demountable connection of a finishing pad to the rotary backing plate is often accomplished with the use of a hook and loop fastening system (i.e. Velcro). However, it is well known that such hook and loop fasteners often deteriorate under the vibration of high speed rotation and fail prematurely. It is also known to utilize flexible polyester or other plastic layers to form laminated backing layers in lieu of woven jute or similar natural fibers.

All of the foregoing surface finishing pads require multiple steps or operations in their fabrication. A more simple and less labor intensive finishing pad construction would be desirable because the pads are eventually worn to the point where they must be discarded. Utilization of less costly materials in fabrication of the pad would also be desirable.

SUMMARY OF THE INVENTION

In accordance with the present invention, a rotary surface finishing tool, preferably utilizing a polymer foam finishing medium, comprises a simple three-piece construction that may be assembled in a two-piece die utilizing a simple crimping technique. The three-piece assembly includes the foam body, a cup-shaped backing plate, and a locking ring.

In accordance with the preferred method of making the finishing tool, a relatively rigid circular backing plate is placed to engage the foam body opposite the finishing face. The backing plate may comprise a stamped steel shell, but other malleable materials, such as aluminum, may also be used. The flexible outer peripheral edge of the foam body is deformed around the outer edge of the backing plate and is captured by a locking ring having a diameter less than the diameter of the backing plate. The outer edge of the backing plate is then crimped over the outer edge of the locking ring to secure the edge of the foam body therebetween. Preferably, the outer peripheral edge of the backing plate is preformed to a cup-like shape, and the steps of capturing the foam and crimping the edge of the backing plate over the edge of the ring comprises pressing the foam body, backing plate and locking ring together in a die.

In accordance with one embodiment of the method, the locking ring is provided with an integral rotary drive hub. In accordance with an alternate embodiment, the backing plate is provided with an integral rotary drive hub.

A rotary surface finishing tool of the present invention comprises a generally circular body of a finishing material that includes a flexible peripheral edge, a front finishing face and a rear mounting face. A rigid cup-shaped backing plate engages the mounting face of the finishing material body and the flexible peripheral edge of the material body is wrapped around the cupped outer edge of the backing plate. A locking ring having a circular peripheral edge is pressed against the flexible edge of the material body and into the cup-shaped backing plate. The cupped outer edge of the backing plate is crimped around the peripheral edge of the locking ring to secure the flexible peripheral edge of the finishing material therebetween.

In a preferred embodiment, the finishing material comprises a polymeric foam. In another embodiment, the finishing material comprises a fabric-backed tufted wool or other yarn. The cup-shaped outer edge of the backing plate is formed of a malleable metal, preferably steel or aluminum. A central drive hub is provided which may be alternately formed as part of the locking ring or the backing plate.

BRIEF DESCRIPTION OF THE DRAWINGS

FIG. 1 is a perspective view of a rotary finishing tool of the present invention operatively mounted on the drive spindle of a powered rotary or orbital driver.

FIG. 2 is a vertical section through a pad of one embodiment of the invention, showing schematically the attachment to the drive spindle of the power driver.

FIG. 8 is a sectional detail taken on line 8—8 of FIG. 2.

FIG. 10 is a vertical section through an alternate embodiment of a rotary finishing tool of the present invention.

FIG. 11 is an exploded view of the components of the tool shown in FIG. 10.

DETAILED DESCRIPTION OF THE PREFERRED EMBODIMENTS

Figure 3:
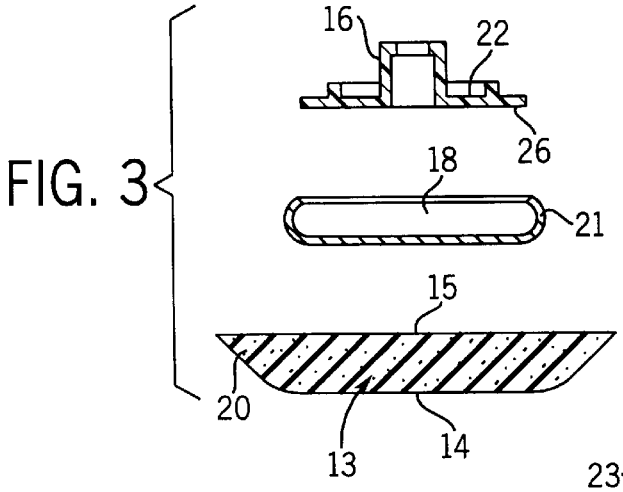
FIG. 3 is an exploded view showing the three-piece construction of the finishing tool of the preferred embodiment.

A rotary finishing tool 10 of the present invention is shown in FIG. 1 operatively mounted on the drive spindle or arbor 11 of a powered rotary driver 12 of a type well known in the art. The rotary driver typically includes an electric motor drive and is held and manipulated by an operator using both hands. As indicated previously, the rotary driver 12 is meant to include orbitally driven finishing tools as well.

The finishing tool 10 in this embodiment includes a polymeric foam body 13 having a generally circular outer finishing face 14. The foam body 13 also has a rear mounting face 15 to which is attached a mounting hub 16, as will be described in greater detail hereinafter. The mounting hub 16 is attached to the drive spindle 11 of the rotary driver 12 utilizing any suitable connecting mechanism. A number of suitable quick mount devices for the mounting hub 16 are disclosed in co-pending application Ser. No. 09/593,427, filed Jun. 14, 2000, and entitled "Quick Mount Attachment for Rotary Finishing Tool", which application is incorporated by reference herein.

Referring to FIG. 2, a rotary drive spindle 11 is shown schematically and includes a center drive post 17, typically of non-circular cross section which is inserted into a similar non-circular recess in the mounting hub 16. However, the particular construction of the mounting hub 16 and drive spindle 11 of the rotary driver may take many different configurations and form no part of the subject invention, apart from their incorporation into one of two of the components of the rotary finishing tool 10.

Referring also to FIG. 3, the rotary finishing tool 10 of the preferred embodiment includes three components which are mechanically interconnected in a die, as will be described. A cup-shaped backing plate 18 is placed against the rear mounting face 15 of the foam body 13. The flexible outer peripheral edge 20 of the foam body 13 is initially caused to wrap around the cupped edge of the backing plate and to be captured between the backing plate and a locking ring inserted thereafter. The edge of the backing plate is then crimped over the outer edge of the locking ring to secure the assembly together.

In FIGS. 4–7, the assembly of the three components shown in FIG. 3 is depicted in a generally schematic progression. The two-piece die is similar in construction and operation to die sets used in the manufacture of buttons of the pin-on type used for advertising, novelty displays and the like.

Figure 4:
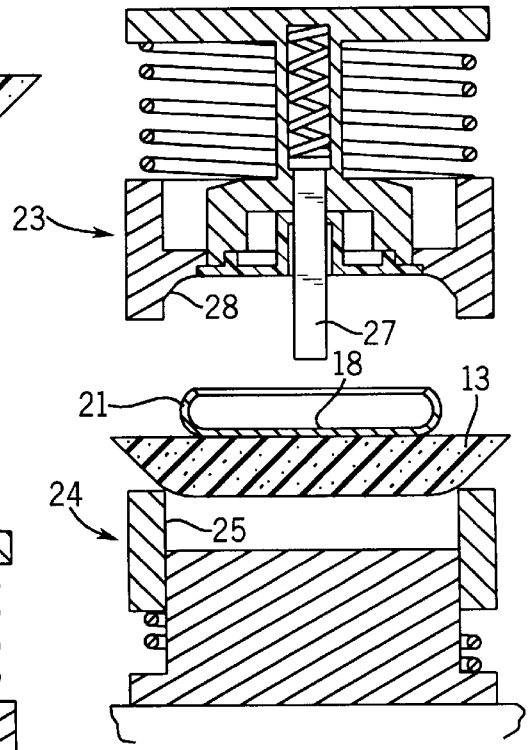
FIGS. 4–7 are somewhat schematic views of the die used in the assembly of the FIG. 3 tool components and depicting the sequential operation of the die to secure the components together.
Figure 5:
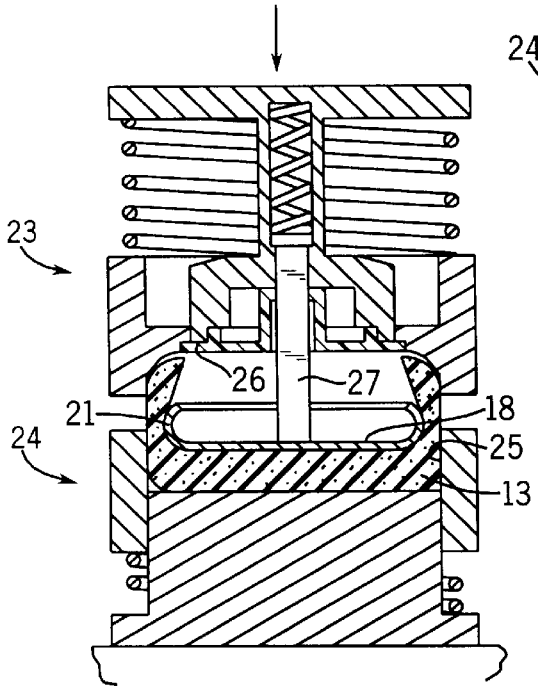
Figure 6:
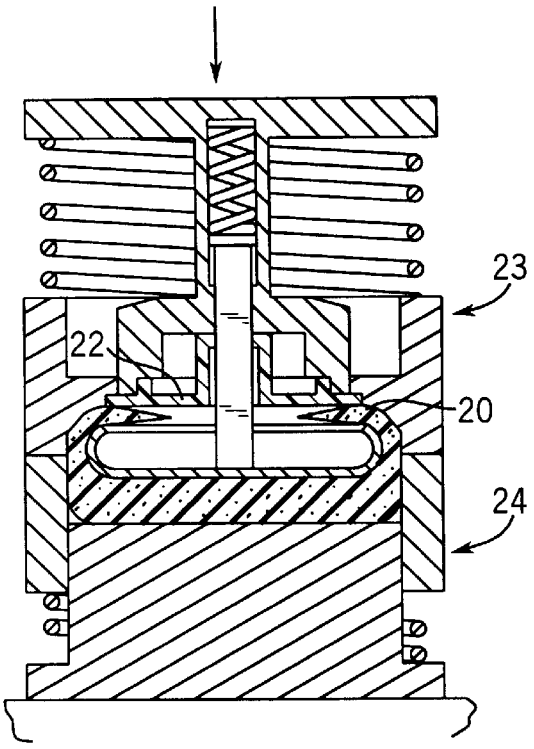
Figure 7:
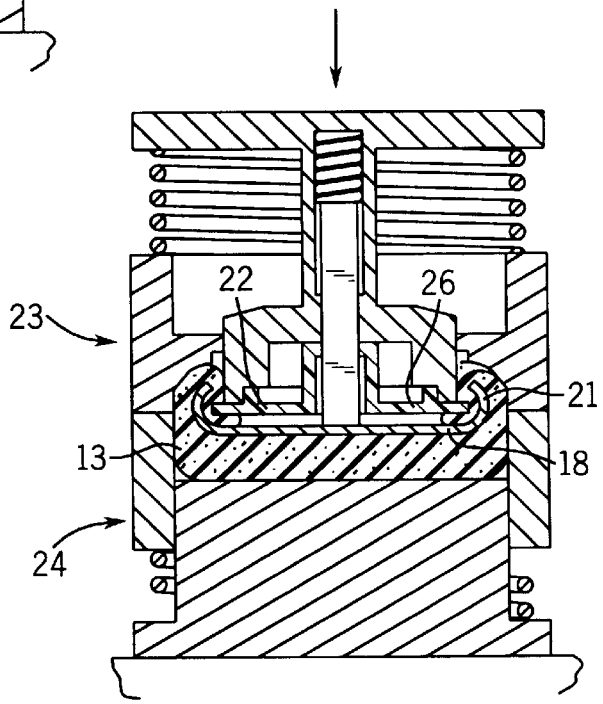

The die set includes an upper die 23 and a lower die 24 which, though shown separated, are normally interconnected and housed together. As shown in FIG. 4, the foam body 13 is placed over a cylindrical recess 25 in the lower die 24 and the cup-shaped backing plate 18 is placed against the rear mounting face 15 of the foam body. The locking member 22, which is in the shape of a generally flat disc 26 with an integral center mounting hub 16, is initially supported in the interior of the upper die 23. As the die members are closed, as shown in FIG. 5, a downwardly extending center post 27 in the upper die 23 initially engages the backing plate 18 and pushes the backing plate and the foam body 13 into the cylindrical recess 25 in the lower die. The flexible outer peripheral edge 20 of the foam body is caused to wrap upwardly around the cupped edge 21 of the backing plate and, referring to FIG. 6, as the die members continue to close, the sloping walls of an upper recess 28 in the upper die 23 causes the peripheral edge of the foam body to wrap inwardly over the cupped edge 21 of the backing plate. As resistance to further compression of the foam body and further downward movement of the backing plate increases, the center portion 30 of the upper die, carrying the locking member 22, continues to move downwardly into the cupped backing plate 18 and, as the dies finally come together, the cupped edge 21 is crimped over the outer edge 31 of the locking disc 26 to secure the assembly together. FIG. 8 shows an enlarged detail of the completed assembly. As shown, the cupped edge 21 of the backing plate is crimped to a position such that the free edge of the cup extends radially inwardly beyond the outer edge 31 of the locking member disc 26.

Figure 9:
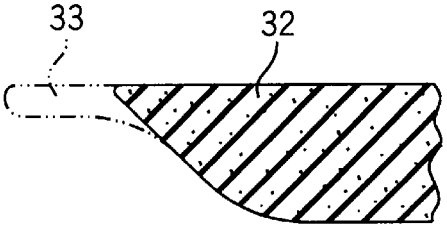
FIG. 9 is a sectional detail of alternate shapes for the polymeric foam body used as the preferred finishing medium for the tool of the present invention.

The foam body 13 shown in FIG. 3 and used in the embodiment just described includes a tapered peripheral edge 20. In an alternate embodiment shown in FIG. 9, the foam body 32 includes a tapered peripheral edge that terminates in a thin lip 33. This configuration may assist in ensuring that the outer edge wraps properly around the cupped edge 21 of the backing plate 18. However, other foam body configurations have been found to work satisfactorily, including a simple cylindrical block body (not shown) having a cylindrical side edge that is perpendicular to the front and rear faces of the body.

In an alternate embodiment shown in FIGS. 10 and 11, the foam body 34 has a curved or spherical front working face 35, a tapered peripheral edge 36, and a recessed rear mounting face 37. The backing plate 38 is of a two piece construction including an annular cup-shaped piece 40 and a central mounting hub 41. The cup-shaped piece 40, like the cupped backing plate 18 of the previously described embodiment, is made of a malleable metal such as steel or aluminum which can be readily crimped. The central mounting hub 41 may be made of plastic and attached to the cup-shaped piece 40 by insert molding. Because the mounting hub is formed as a part of the backing plate 38, the locking member 42 may comprise a simple annular washer. A similar die set, as the two dies 23 and 24, may be used in the assembly of this embodiment. FIG. 10 shows the final assembly with the edge of the cup shaped piece 40 crimped radially inwardly past the outer peripheral edge 43 of the locking member 42.

The thickness of a steel backing plate 18 or 38 may be about 0.008 inch (0.2 mm), but may be as thick as 0.014 inch (0.35 mm) or greater. Indeed, by utilizing heavier tooling and thicker foam body pieces, it is believed that substantially heavier gauge steel or aluminum backing plates could be utilized. The one-piece locking member 22 of the FIG. 3 embodiment may be made of plastic or of metal. Foam body pieces of ½ inch (about 13 mm) in thickness have worked satisfactorily in the assembly of the rotary finishing tools described herein. However, the thickness of the foam material, as well as its diameter and edge shape, may be varied considerably to provide different sized finishing tools with different working surface configurations.

Tufted wool pads or pads utilizing similar materials sewn or attached to a fabric or other flexible backing member may also be used to make finishing tools of the present invention. For example, a flexible jute backing member carrying a tufted wool finishing face may be readily wrapped around the cup-shaped edge of backing plate 18 or 38 in the manner described herein and crimped over the edge of a suitable locking member 22 or 42, all as described hereinabove.

Figure 12:
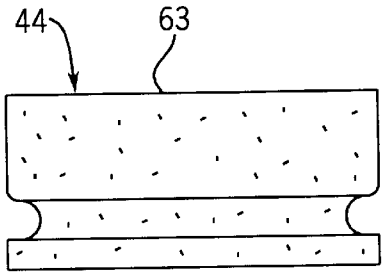
FIG. 12 is a side elevation of another configuration of a polymeric foam body used to form a finishing tool in a modified die set.
Figure 13:
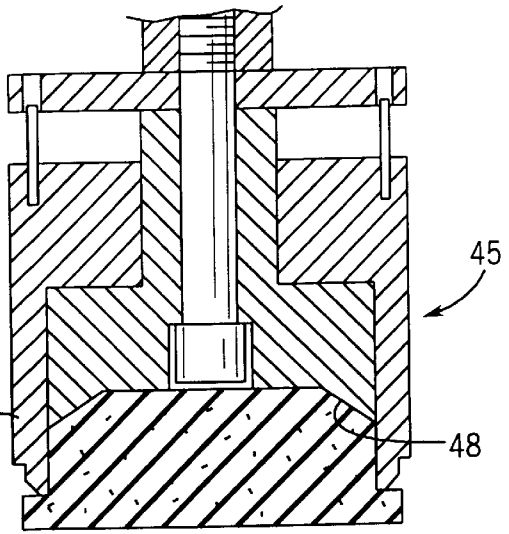
FIGS. 13 and 14 show a modified three-piece die set utilizing the FIG. 12 foam body, and the backing plate and locking member of the previously described embodiments.
Figure 14:
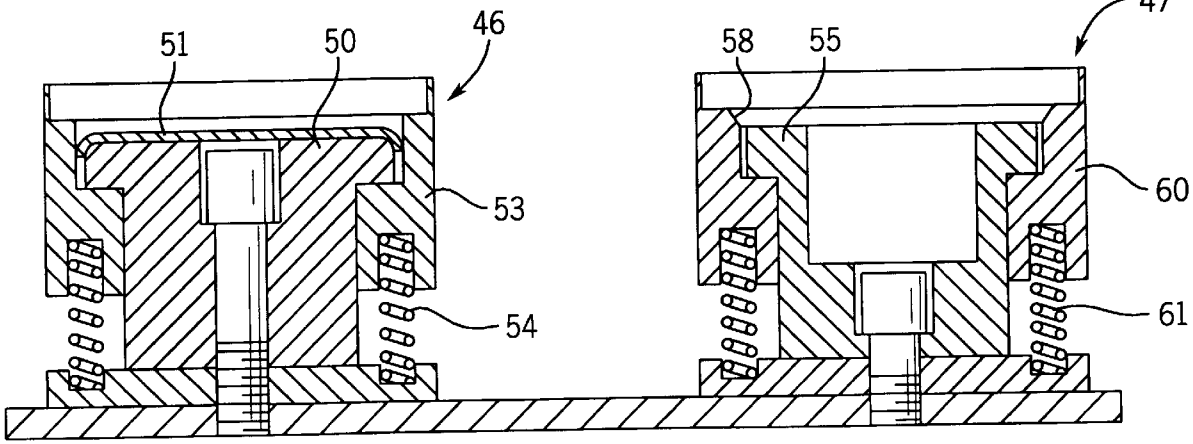
Figure 15:
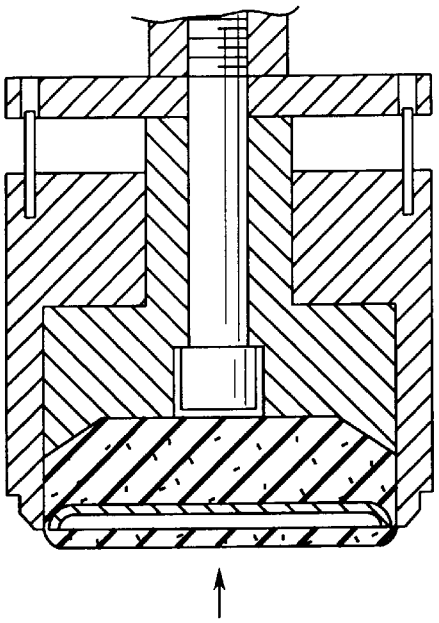
FIG. 15 is an elevation view of the common die piece shown in FIG. 13 after initial attachment of the backing plate to the foam body.

FIGS. 13–17 show the components of a modified embodiment of a finishing tool of the present invention and a modified three-piece die set used for its manufacture. The polymer foam pad body 44 of FIG. 12 is shown in side elevation and has a circular shape when viewed in plan. FIG. 13 shows schematically a common upper die piece 45 which operates sequentially with first and second lower die pieces 46 and 47 to assemble the rotary finishing tool using the pad body 44. The foam pad body 44 is initially loaded into a conical recess 48 in the underside of the common upper die piece 45, as shown in FIG. 13. The upper die piece is initially positioned above the first lower die piece 46 which includes a central platform 50 on which is supported a backing plate 51. The backing plate may be identical to backing plate 18 of the embodiment first described above. The upper die piece 45 is brought down against the first lower die piece 46 to force the foam body 44 against the backing plate 51. Eventual contact between the lower edge of an outer sleeve 52 on the upper die piece and the upper edge of a vertically slidable sleeve 53 on the first lower die piece 46 forces the slidable sleeve 53 downwardly against the bias of springs 54, allowing the edge of the foam body to wrap around the cupped edge of the backing plate 51. The backing plate is captured in the face of the foam body such that, upon upward retraction of the upper die piece 45, the foam body and attached backing plate are lifted from the first lower die piece 46, as shown in FIG. 15.

Figure 17:
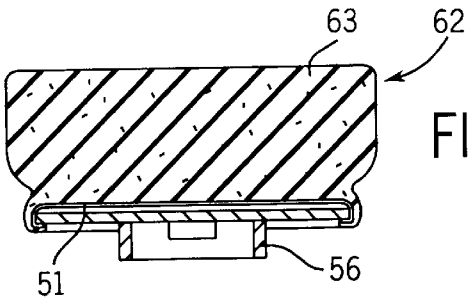
FIG. 17 is a side elevation of the completed finishing tool after removal from the FIG. 16 die.
Figure 16:
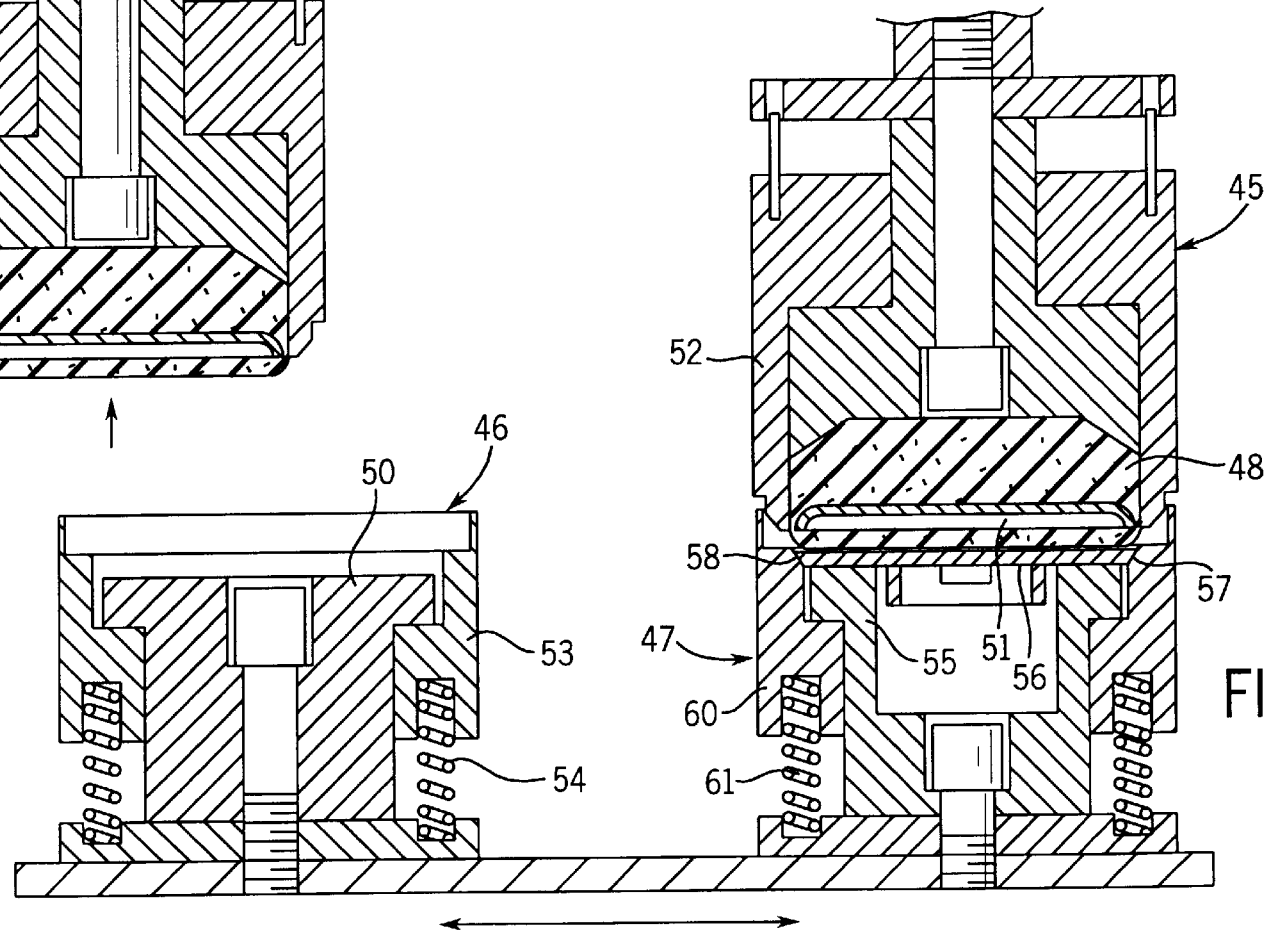
FIG. 16 is a view of the three-piece die set of FIGS. 13 and 14 showing the final crimping of the backing plate to the locking member.

The second lower die piece 47 is then moved into vertical alignment with the upper die piece 45, as shown in FIG. 16. The second lower die piece 47 includes a central support 55 upon which a locking member 56 is placed. The locking member 56 may be identical to the locking member 22 of the embodiment first described above. The peripheral edge 57 of the locking member 56 rests initially on a frustoconical shoulder 58 formed on the upper edge of a second slidable sleeve 60 on second lower die piece 47. The upper die piece 45 (carrying the preassembled foam body and backing plate) is then lowered from the FIG. 15 position to the FIG. 16 position, initially bringing the edge of the foam body which has been wrapped around the backing plate into contact with the locking member 56 on the second lower die piece 47. Further downward movement of the upper die piece 45 causes the lower edge of the outer sleeve 52 to engage the upper edge of the slidable sleeve 60, forcing it downwardly against the bias of springs 61. This causes the cupped edge of the backing plate 51 to be forced against the frustoconical shoulder 58 and to crimp the edge inwardly around the peripheral edge 57 of the locking member 56, thereby securing the three piece assembly together. The assembled finishing tool 62 is shown in FIG. 17 where the foam body 44 has expanded from its compressed shape within the conical recess 48 to exhibit a generally flat finishing face 63. Of course, the pad body 44 could be initially formed with a concave, convex, or any other shape of finishing face to which it would re-expand upon completion of the assembly.

I claim:

1. A method for making a rotary polymeric foam body finishing tool having a generally circular foam finishing face and a relatively rigid circular backing plate engaging the foam body opposite the finishing face, comprising the steps of:

(1) providing the backing plate with a peripheral edge of a malleable material;

(2) capturing the peripheral edge of the foam between the peripheral edge of the backing plate and a locking ring having a diameter less than the diameter of the backing plate; and;

(3) crimping the peripheral edge of the backing plate over the outer edge of the backing ring to secure the foam body to the backing plate.

2. The method as set forth in claim 1 including the steps of:

(1) preforming the peripheral edge of the backing plate with a cup-like shape; and, (2) capturing the foam and crimping the edge of the backing plate by pressing the foam body, backing plate and locking ring together in a die.

3. The method as set forth in claim 1 wherein the backing plate is steel.

4. The method as set forth in claim 1 including the step of providing said locking ring with an integral rotary drive hub.

5. The method as set forth in claim 1 including the step of providing said backing plate with an integral rotary drive hub.

6. A rotary surface finishing tool comprising:

a generally circular body of a finishing material having a flexible peripheral edge, a front finishing face and rear mounting face;

a rigid cup-shaped backing plate engaging the mount face of the finishing material body and having the flexible peripheral edge thereof wrapped around the cupped outer edge of the backing plate;

a locking ring having a circular peripheral edge pressed against the flexible edge of the material body and into the cup-shaped backing plate;

the cupped outer edge of the backing plate crimped around the peripheral edge of the locking ring to secure the flexible peripheral edge of the finishing material therebetween.

7. The surface finishing tool as set forth in claim 6 wherein said finishing material comprises a polymeric foam.

8. The surface finishing tool as set forth in claim 6 wherein said finishing material comprises a fabric backed tufted yarn.

9. The surface finishing tool as set forth in claim 6 wherein the cupped outer edge of the backing plate is formed of a malleable metal.

10. The surface finishing tool as set forth in claim 9 wherein the metal is steel.

11. The surface finishing tool as set forth in claim 6 wherein the locking ring includes a central drive hub.

12. The surface finishing tool as set forth in claim 6 wherein the backing plate includes a central drive hub.

* * * * *

UNITED STATES PATENT AND TRADEMARK OFFICE

CERTIFICATE OF CORRECTION

PATENT NO. : 6,368,202 B1
DATED : April 9, 2002
INVENTOR(S) : Richard A. Kaiser

It is certified that error appears in the above-identified patent and that said Letters Patent is hereby corrected as shown below:

Column 6,
Line 8, delete "backing" and substitute -- locking --.

Signed and Sealed this

Twenty-fourth Day of September, 2002

*Attest:*

*Attesting Officer*

JAMES E. ROGAN
*Director of the United States Patent and Trademark Office*